US007275280B2

(12) United States Patent
Haegermarck et al.

(10) Patent No.: US 7,275,280 B2
(45) Date of Patent: Oct. 2, 2007

(54) WHEEL SUPPORT ARRANGEMENT FOR AN AUTONOMOUS CLEANING APPARATUS

(75) Inventors: Anders Haegermarck, Trångsund (SE); Ulrik Danestad, Västervik (SE); Lars Mennborg, Vikingstad (SE)

(73) Assignee: Aktiebolaget Electrolux, Stockholm (SE)

( * ) Notice: Subject to any disclaimer, the term of this patent is extended or adjusted under 35 U.S.C. 154(b) by 564 days.

(21) Appl. No.: 10/469,261

(22) PCT Filed: Feb. 25, 2002

(86) PCT No.: PCT/SE02/00341

§ 371 (c)(1),
(2), (4) Date: Mar. 11, 2004

(87) PCT Pub. No.: WO02/067744

PCT Pub. Date: Sep. 6, 2002

(65) Prior Publication Data

US 2004/0143927 A1 Jul. 29, 2004

(30) Foreign Application Priority Data

Feb. 28, 2001 (SE) ..... 0100676

(51) Int. Cl.
*A47L 9/00* (2006.01)

(52) U.S. Cl. ..... 15/340.1; 15/340.3; 15/319; 15/339; 15/377

(58) Field of Classification Search ..... 15/319, 15/340.1, 340.3, 362, 339, 377; 305/134, 305/141; 301/111.05, 133
See application file for complete search history.

(56) References Cited

U.S. PATENT DOCUMENTS

| | | | | |
|---|---|---|---|---|
| 1,177,237 | A * | 3/1916 | Egan | 301/133 |
| 1,443,556 | A * | 1/1923 | Beal et al. | 305/132 |
| 1,836,446 | A * | 12/1931 | Christie | 305/141 |
| 2,692,770 | A * | 10/1954 | Nallinger et al. | 301/133 |
| 4,501,452 | A * | 2/1985 | Huang | 305/132 |
| 4,852,677 | A | 8/1989 | Okazaki | |
| 5,156,038 | A | 10/1992 | Kozikaro | |
| 5,214,822 | A | 6/1993 | Sakurai et al. | |
| 5,353,224 | A | 10/1994 | Lee et al. | |
| 5,402,365 | A | 3/1995 | Kozikaro et al. | |

(Continued)

FOREIGN PATENT DOCUMENTS

EP 0 803 224 A2 10/1997

(Continued)

*Primary Examiner*—Theresa T. Snider
(74) *Attorney, Agent, or Firm*—Pearne & Gordon LLP

(57) ABSTRACT

A carrier, such as an autonomous cleaning apparatus, has a self-adjusting wheel assembly that can move vertically, thereby enabling the carrier to readily pass over a surface. The wheel assembly may include microswitch, which activates a control mechanism for the carrier when a wheel assembly is in a predetermined position along its path of vertical movement. Rollers can be located at the bottom of the carrier to function in cooperation with the wheel assemblies so as to facilitate the ability of the carrier to pass over obstacles. This ability may be enhanced by constructing the bottom of the front portion of the carrier so that it is slanted or inclined upwardly in a direction outward from the bottom of the carrier. A driving wheel may be rotatably attached to a wheel support, and which may also support a power source and a transmission.

35 Claims, 3 Drawing Sheets

U.S. PATENT DOCUMENTS

| | | | | |
|---|---|---|---|---|
| 5,440,216 | A | 8/1995 | Kim | |
| 5,684,695 | A | 11/1997 | Bauer | |
| 5,720,077 | A | 2/1998 | Nakamura et al. | |
| 5,794,166 | A | 8/1998 | Bauer et al. | |
| 5,815,880 | A | 10/1998 | Nakanishi | |
| 5,873,145 | A * | 2/1999 | Chou | 301/111.05 |
| 5,935,179 | A | 8/1999 | Kleiner et al. | |
| 2004/0187249 | A1 * | 9/2004 | Jones et al. | 15/319 |

FOREIGN PATENT DOCUMENTS

| | | |
|---|---|---|
| JP | 9-319435 | 12/1997 |
| WO | WO95/26512 | 5/1995 |
| WO | WO97/40734 | 11/1997 |
| WO | WO97/41451 | 11/1997 |
| WO | WO99/40496 | 8/1999 |
| WO | WO99/59402 | 11/1999 |
| WO | WO/00/10062 | 2/2000 |
| WO | WO 00/38025 | 6/2000 |
| WO | WO 00/38028 | 6/2000 |
| WO | WO 00/38029 | 6/2000 |

* cited by examiner

WHEEL SUPPORT ARRANGEMENT FOR AN AUTONOMOUS CLEANING APPARATUS

FIELD OF THE INVENTION

The invention set forth herein relates, in general, to carriers having self-adjusting motive means that serve to transport the carriers over a surface, the self-adjusting feature allowing the motive means to move or be displaced upwardly or downwardly, thereby enabling the carrier to readily pass over the surface irrespective of the type of surface, the condition of the surface or the presence of obstructions or obstacles on the surface. The motive means can be incorporated into an assembly that includes actuating means mounted on the motive means so as to be displaced concomitantly with the motive means, as the motive means is displaced upwardly or downwardly, the actuating means thereby activating a control mechanism that controls an operational function of the carrier. The carrier can also be provided along its bottom with rotatable support means that define the minimum spacing, or gap, between the bottom of the carrier and the location on, or within, the surface at which the rotatable support means rest. The rotatable support means also performs the function of providing a pivot, or tilting site, when the carrier is forced upwardly under the influence of an object or obstacle on the surface over which the carrier moves. In this connection, the ability of the carrier to move over obstacles can be facilitated by constructing the base of the front, or leading, section of the carrier so that it is slanted or inclined, with the inclination extending upwardly and outwardly from the bottom of the carrier.

The foregoing features of the invention can be effectively incorporated into a carrier which performs a surface-conditioning operation on the surface over which it traverses. In particular, the invention is especially useful as applied to an autonomous cleaning apparatus such as a robot vacuum cleaner. A robot vacuum cleaner, typically, comprises a housing enclosing a dust or dirt container and an electrically driven vacuum source for drawing dust and dirt into the container. A floor-engaging nozzle, through which dust and dirt flow into the container, is also accommodated within the housing. The housing is directly or indirectly supported by a wheel arrangement or motive means on which the vacuum cleaner moves about, the wheel arrangement having individually driven wheels for moving the vacuum cleaner over a floor surface.

BACKGROUND OF THE INVENTION

Robot vacuum cleaners of the type referred to above are known; see for instance WO 9740734 and EP-A-803224. These robot vacuum cleaners, which, preferably, are battery driven, are provided with a circular housing and with means for sensing surrounding objects or obstacles so as to avoid, or otherwise deal with, such objects and obstacles during a vacuum cleaning operation. The vacuum cleaner is automatically guided past the objects or obstacles and can vacuum hard as well as soft floor surfaces. The driving wheels are typically arranged for rotation on separate horizontal shafts that are placed in coaxial alignment with one another for rotation about a common axis. Also, normally, the driving wheels are rotatably supported by bearings that are permanently fixed in relation to the housing. By means of the circular housing shape, and by driving the wheels at varying velocities and in different rotational directions, the vacuum cleaner can be automatically moved and guided such that any tendencies for the cleaner to become stuck or otherwise restrained in its operation are minimized.

Although the prior art arrangement described above works well under most circumstances, the fixed-wheel design with which the prior art vacuum cleaners are provided can result in operational failures when the vacuum cleaner encounters obstacles such as, for example, rugs having high or loose edges or thresholds. It is not always possible for such fixed-wheel cleaners to be guided past such obstacles. In order to minimize this difficulty, there are broad suggestions in the prior art, e.g. see U.S. Pat. Nos. 5,720,077 and 5,815,880, that a suspension mechanism can be provided for the driving wheels so as to allow the wheels to engage the floor surface even if there are recesses, undulations or the like in the floor surface. However, no specific wheel assembly is described for accomplishing that result.

SUMMARY OF THE INVENTION

The purpose of the present invention is to provide a simple and efficient, self-adjusting motive means, such as a driving wheel assembly, for a carrier such as a surface-conditioning apparatus. In a specific application, the invention is used with the driving wheels of a cleaning apparatus, preferably a robot vacuum cleaner, whereby the vacuum cleaner easily climbs over or otherwise avoids objects and obstacles it may encounter during its operation. Another purpose of the invention is to provide at the bottom of the carrier rotatable support means, such as wheels or rollers, which are rotatably fixed to the carrier so as to define the minimum spacing, or gap, between the bottom of the carrier and the location on, or within, the surface at which the support means rest, the rotatable support means also functioning to establish a pivot, or tilting site, when the carrier is forced upwardly under the influence of an object or obstacle on the surface engaging the carrier. A further purpose of the invention is to facilitate the movement of the carrier over obstacles or obstructions by constructing the front or leading section of the bottom of the carrier so that it is slanted or inclined, with the inclination extending upwardly and outwardly from the bottom of the carrier. Yet another purpose of the invention is to provide the carrier with a control mechanism, such as a microswitch, to be engaged and operated by an actuating means associated with the motive means when the motive means, during the course of its self-adjustment, assumes a predetermined position, such as when it comes out of contact with the surface over which the carrier is traversing.

In accordance with one aspect, the present invention provides an assembly by means of which a carrier may move over a surface irrespective of obstructions or obstacles on the surface. The assembly comprises a motive means for engaging and moving over the surface so as to transport the carrier when the motive means is in an operative mode with the carrier. The motive means is adapted for displacement in both upward and downward directions and actuating means associated with the motive means for actuating a control mechanism when the motive means is in the operative mode and the motive means is in a predetermined position along its path of upward and downward movement.

In accordance with another aspect, the present invention provides a motive means for engaging and moving over a surface so as to transport a carrier when the motive means is in an operative mode with the carrier. The motive means is adapted for displacement in both upward and downward directions. The motive means includes a support means, force-creating means supported by the support means for urging the motive means in a direction downward from the carrier when the motive means is in the operative mode and a guide means slidably connected to the support means and adapted to be fixed to the carrier so as to cause the motive means to traverse a vertical path in its upward and downward displacement.

In accordance with another aspect, the present invention provides an autonomous surface-conditioning apparatus. The apparatus has a housing, which contains surface-conditioning elements, and includes a control mechanism for controlling the operation of the surface-conditioning apparatus. The apparatus has a motive means attached to the housing by means of which the apparatus may move over a surface being conditioned irrespective of obstructions or obstacles on the surface. The motive means is adapted for displacement in both upward and downward directions and includes actuating means for actuating the control mechanism when the motive means is in a predetermined position along its path of upward and downward displacement.

In accordance with yet another aspect, the present invention provides an autonomous surface-conditioning apparatus. The apparatus has a housing, which contains surface-conditioning elements, and includes an assembly attached to the housing by means of which the apparatus may move over a surface being conditioned irrespective of obstructions or obstacles on the surface. The assembly comprises a motive means for engaging and moving over the surface so as to transport the apparatus. The motive means is adapted for displacement in both upward and downward directions. The motive means includes a support means, a force-creating means supported by the support means for urging the motive means in a direction downward from the apparatus, and a guide means fixed to the apparatus and slidably connected to the support means so as to cause the motive means to traverse a vertical path in its upward and downward displacement.

In accordance with still another aspect, the present invention provides an autonomous surface-conditioning apparatus. The apparatus has a housing, which contains surface-conditioning elements, and includes an assembly attached to the housing by means of which the apparatus may move over a surface being conditioned irrespective of obstructions or obstacles on the surface. The assembly comprises a motive means for engaging and moving over the surface so as to transport the apparatus. The motive means is adapted for displacement in both upward and downward directions, front and rear rotatable support means rotatably fixed to the bottom of the apparatus and acting to both establish a gap between the bottom of the apparatus and the surface being conditioned and a site about which the apparatus may tilt.

The foregoing and other objects, features, aspects and advantages of the present invention will become more apparent from the following detailed description thereof when taken in conjunction with the accompanying drawings.

DESCRIPTION OF PREFERRED EMBODIMENT

Figure 1:
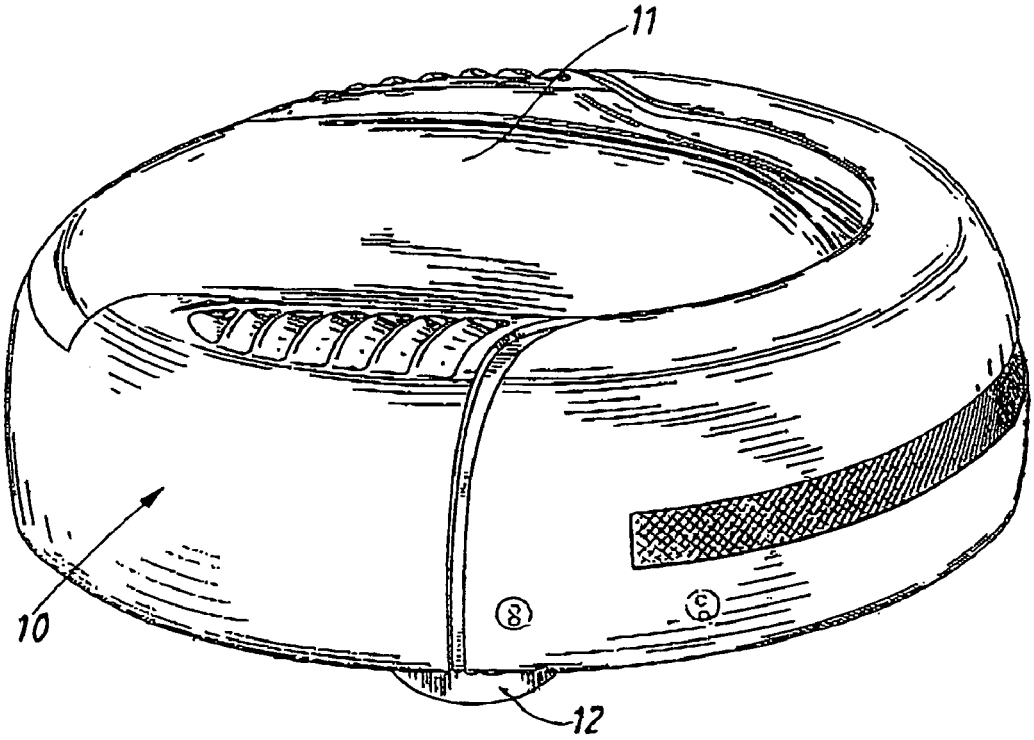
FIG. 1 is a perspective view of a robot vacuum cleaner for which the invention can be used.
Figure 2:
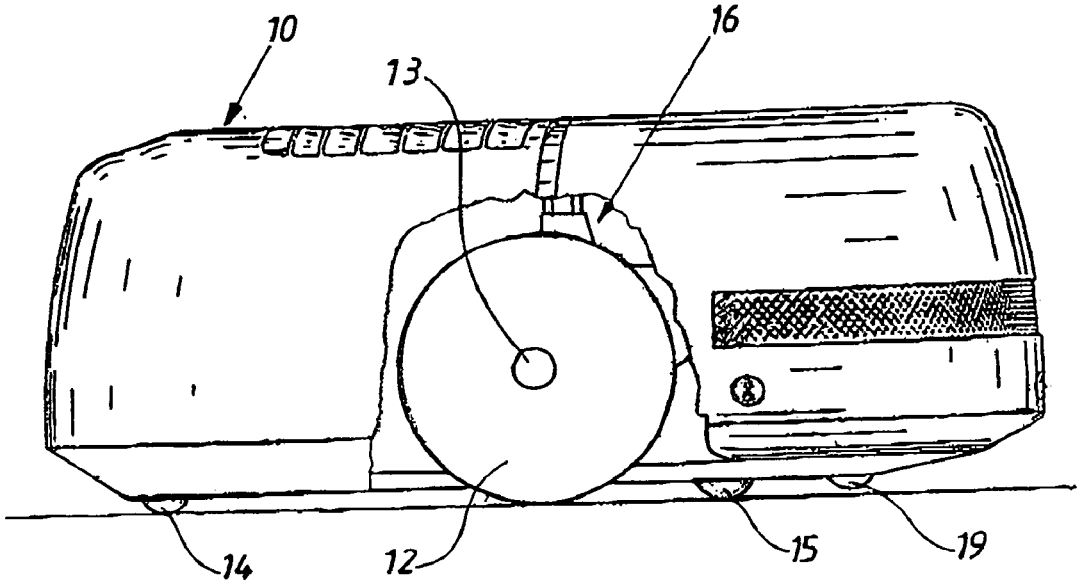
FIG. 2 shows, schematically, a partly broken side view of the robot vacuum cleaner shown in FIG. 1.
Figure 3:
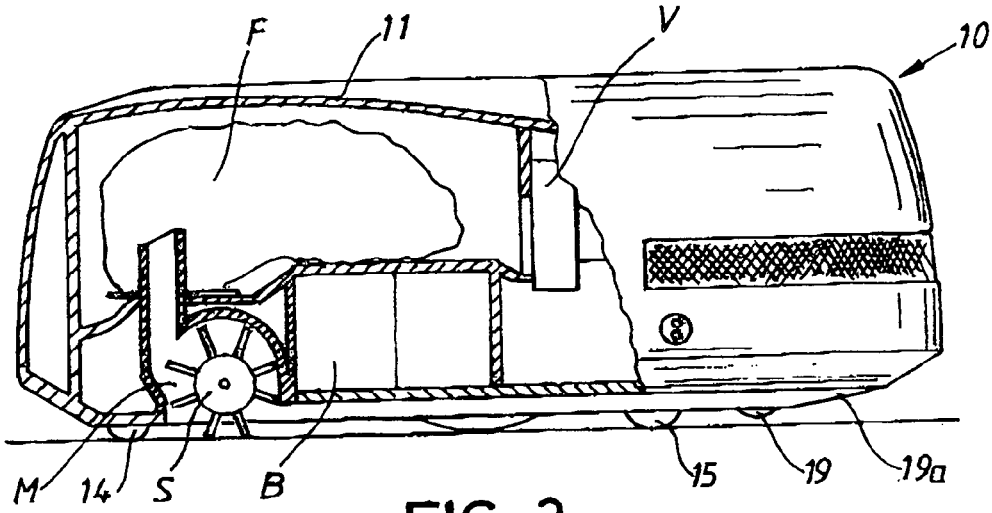
FIG. 3 shows a further partly broken side view of the robot vacuum cleaner of FIG. 1.

With reference to FIGS. 1-3, a carrier in the form of an autonomous cleaning apparatus, or robot vacuum cleaner, has a circular housing 10 with a cover 11 concealing a chamber in which a dust container or collector, designed as a filter cassette or a filter container F, is located. Alternatively, the housing might enclose a centrifuge cyclone separator, well known in the art, by means of which dust and particulate matter are separated from the air and are collected in the dust container F. The housing 10 also encloses a vacuum source V, typically a fan unit, that is driven by an electric source such as a battery B located in a battery holder. The container F is in fluid communication with a nozzle M located at the bottom of the housing and through which the dust and dirt-laden air is sucked and evacuated into container F. The nozzle M encloses and rotatably supports a rotating brush roll S that loosens dust and dirt from the surface over which the cleaner passes so that the surface can be more readily vacuumed. The housing also encloses the usual electric circuits and control means that are necessary for driving the fan unit and the brush roll. Also located within the housing are means for automatically guiding the robot vacuum cleaner about the floor surface of the room. Such means include, for example, ultrasonic transmitters and receivers with associated microprocessor-based controls and related sensors intended to map an appropriate pattern of movement of the vacuum cleaner and alter that movement when the robot vacuum cleaner encounters an object or obstacle. With reference to FIGS. 2 and 3, most of the time, the robot vacuum cleaner, in performing its functions, will proceed from left to right and the leading circumferential portion of the vacuum cleaner is referred to as the front of the cleaner and the trailing circumferential portion of the cleaner is referred to as the rear of the cleaner.

Figure 4:
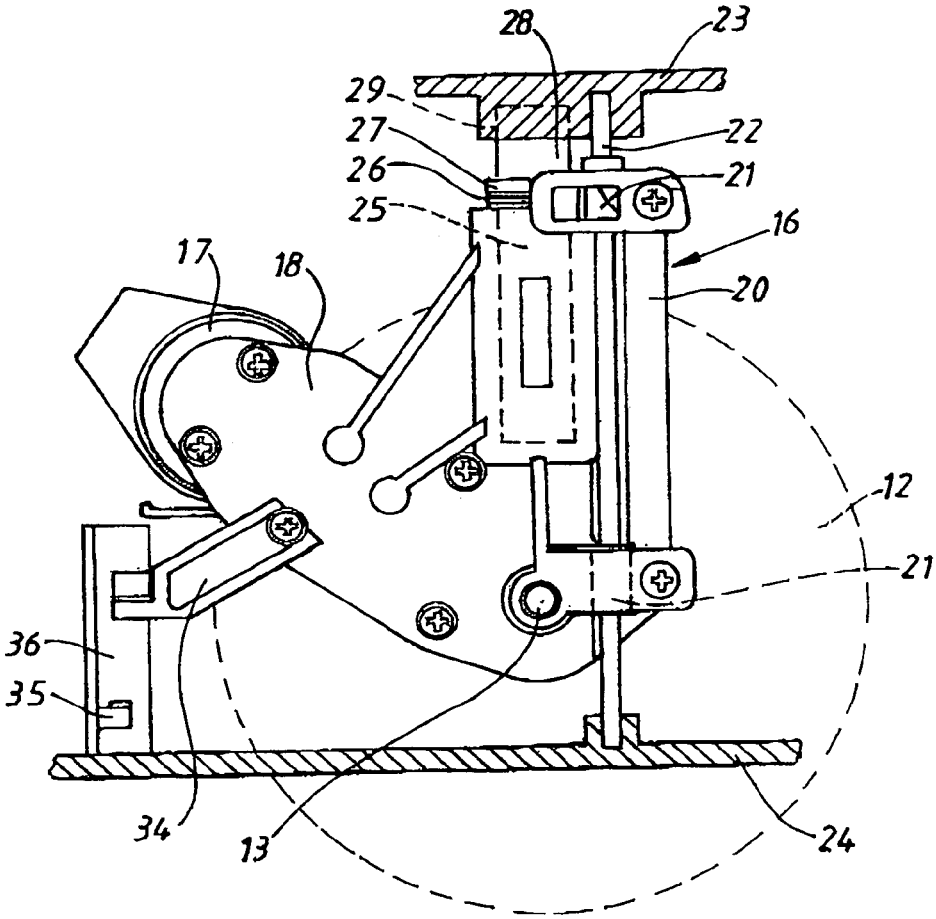
FIG. 4 shows the motive means or driving wheel assembly, including a support structure, of the robot vacuum cleaner in a position in which the cleaner rests on a floor surface.
Figure 6:
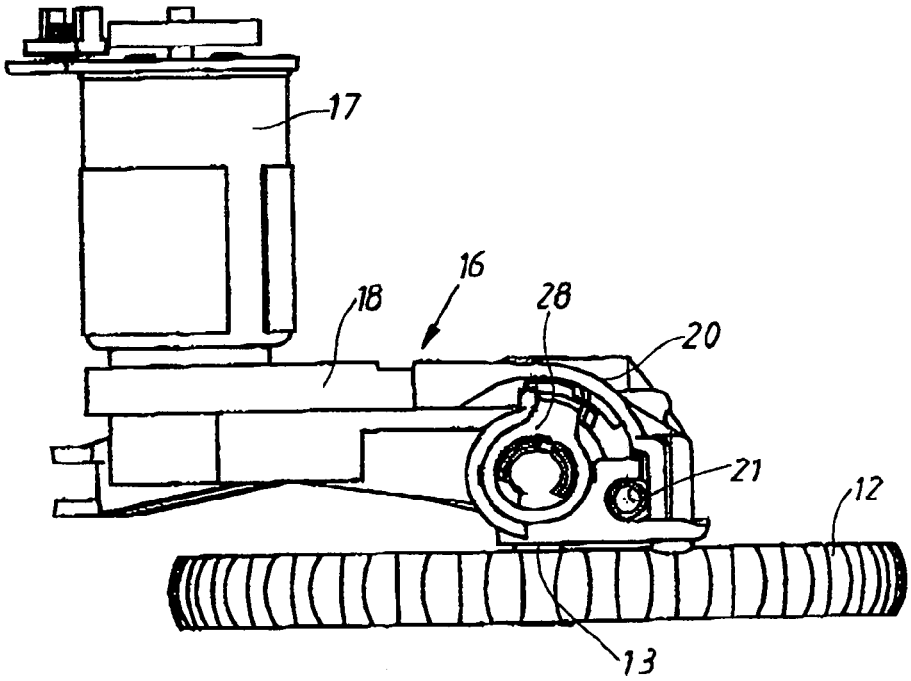
FIG. 6 is a plan view of the motive means or driving wheel assembly shown in FIG. 5 with a driving wheel mounted thereon.

The robot vacuum cleaner is also provided, see FIG. 2, with two diametrically opposed and independently driven driving wheels 12 that are located near the periphery of the housing. These wheels are part of the motive means shown in FIGS. 4 and 6 for engaging and moving over a surface so as to transport the robot vacuum cleaner when the motive means and cleaner are in an operative mode. Each driving wheel is attached to a drive wheel shaft 13. The driving wheels 12, preferably, have toothed plastic or rubber treads or are made of some other material having a high coefficient of friction in order to avoid slippage when they are in contact with the floor surface. Each drive wheel shaft 13 is supported on a drive wheel support 16, which also forms a part of the motive means as shown in FIGS. 4 and 6. Mounted on each drive wheel support are an electric motor 17 and a transmission 18, such as a cog wheel transmission or the like. Each transmission 18 is interposed between and connects the motor shaft of an electric motor 17 with the corresponding drive shaft 13. The transmission 18 gears down the speed of the electric motor shaft to the drive wheel 12, thereby increasing torque when required. Thus, each drive wheel support brings together corresponding motor, transmission and driving wheel into a single integrated unit that can be easily mounted into the housing 10.

Figure 5:
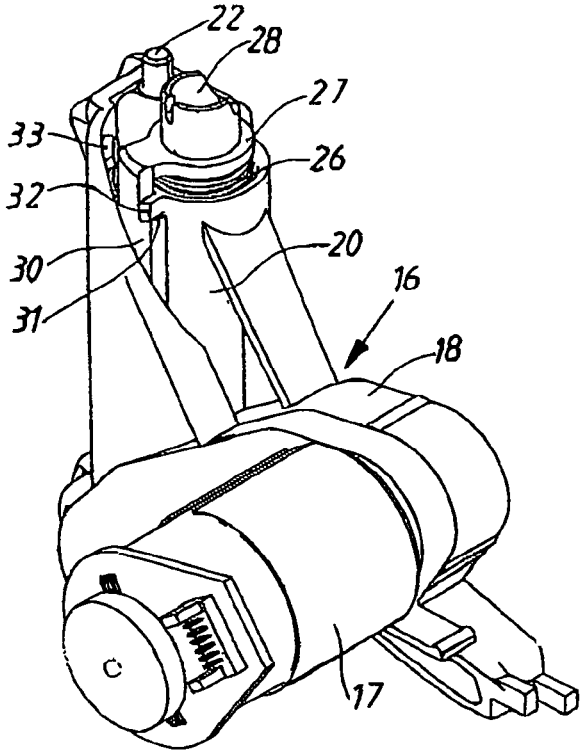
FIG. 5 shows a perspective view of the motive means or driving wheel assembly, including a support structure, before a driving wheel is mounted thereon and before the assembly it is mounted into the robot vacuum cleaner housing.

The driving wheel support 16, which is a part of the motive means, is adapted and arranged to allow for upward and downward movement, or displacement, along a vertical path within the housing, as shown in a FIGS. 4 and 5. To accomplish that vertical movement, support 16 is provided with a first upwardly directed part 20 to which upper and lower slide bearings 21 are fastened. The bearings surround a vertical slide rail 22 which is fixed at the upper and lower wall parts 23 and 24, respectively, of the housing 10. The slide rail 22 serves as a means for guiding the vertical movement of the driving wheel support, and, in conjunction with the force-creating means, further described below, allows the driving wheel to remain in contact with the floor surface should the surface be uneven or bumpy or should the robot vacuum cleaner encounter obstacles or obstructions. Other guide means may also be employed to guide the vertical movement of the driving wheel support.

The upwardly directed part 20 of the drive wheel support also has means in the form of an upwardly open cylindrical recess which receives a dowel 25. Integral with the dowel 25 at its upper end is an outwardly extending annular collar 27. One end of a force-creating means, such as a coil spring 26, for example, or some other compressible, resilient device engages the dowel at its annular collar. The other end of the spring rests on the bottom of the cylindrical recess in which the lower end of the dowel is situated. The dowel is positioned such that it normally can be moved vertically upwardly and downwardly under the influence of the spring or other force-creating means. The spring 26 is designed such that the force created by the spring on the driving wheel support is approximately constant during the vertical movement of the driving wheel support. The upper end 28 of the dowel rests in a seat 29 in the upper wall 23 of the housing 10. Integral with the collar 27 is a downwardly directed tongue 30 (see FIG. 5) that extends parallel to the upwardly directed part 20. The tongue includes a hook-shaped portion 31 which cooperates with a stop means 32, such as a tab, arranged at the outside of the upwardly directed part 20.

The tongue 30 is provided at its lower part with a lug, not shown, cooperating with an additional stop means 33 arranged on the upwardly directed part 20. The lug and the stop means 33 cooperate in such a manner that the movement of the dowel is limited to avoid it becoming free from the upwardly directed part 20. As a result, the risk is reduced that the various components described will become separated from one another under the influence of the force of the spring when the driving wheel assembly is not mounted within housing 10.

Each driving wheel support 16 also has an actuating means or extending arm 34 whose outer end is intended to engage a control mechanism or microswitch 35 which is mounted on a bracket 36 located at the lower wall 24 of the housing 10. The microswitch 35 is acted on by the actuating means 34 when the wheel 12 is in a predetermined position along its path of upward and downward movement, such as when it is in an extended position out of contact with the floor surface being cleaned as would occur, for example, when the vacuum cleaner is lifted from the floor surface or when the vacuum cleaner has been raised a significant distance from the floor surface as a result of engaging an obstacle. Each microswitch 35 serving a driving wheel assembly is connected to the electric circuit of the robot vacuum cleaner such that the function of the robot vacuum cleaner is suitably influenced if one or both wheels are moved to their extended positions. For example, the vacuum cleaner motor may be deactivated, or the direction of rotation of one or both wheels may be changed, or some other corrective action may be automatically implemented.

The housing is also provided with rotatable support means 14 and 15. The support means can comprise either rollers or wheels, for example. The rear support means 14 and the front support means 15 are rotatably attached to the housing 10 and aid in both supporting the robot vacuum cleaner above the floor surface and moving the robot vacuum cleaner across the floor surface. Two coaxially aligned rear support means 14 are provided. The two rear support means are located on opposite sides of an a central axis through the center of the housing and extending along the direction of movement of the vacuum cleaner (i.e. to the right in FIG. 2) and behind the driving wheel shafts 13. The single front support means 15 is located on that same central axis and in front of the shafts 13. The support means 14 and 15, because they are fixedly attached to the housing 10, establish the minimum spacing, or gap, between the bottom of the robot vacuum cleaner and the floor surface, particularly when the floor is somewhat hard and substantially flat and/or substantially smooth. Of course, when the robot vacuum cleaner is placed on a loosely woven carpeted surface, the support means 14 and 15 will sink into the carpet and the carpet fibers will extend somewhat into the gap that the support means create. In addition to providing this support function, the support means 14 and 15 also serve as a pivot or tilting site about which the housing may pivot or tilt when an obstacle or obstruction is encountered as more fully explained below.

The vacuum cleaner is also provided with further rotatable support means 19 located at the bottom of the front part of the vacuum cleaner forwardly and upwardly of the front support means 15. The further support means 19, as in the case of support means 14 and 15, comprises either a roller or a wheel, for example. The further support means 19 are located on the housing 10 so that during normal forward motion of the vacuum cleaner (i.e. motion to the right in FIG. 2) on a hard, substantially flat floor surface, the further support means 19 is typically somewhat above and out of contact with the floor. However, when the robot vacuum cleaner encounters a loose or flabby rug, or another relatively low-profile obstacle, the further support means 19 comes into contact with the rug or obstacle, enabling the vacuum cleaner to pass up and over such rug and/or obstacle without wrinkling or crushing it and without the cleaner being overly hindered in its movement. The bottom of the front of the housing 10 is also provided with an upwardly and outwardly slanting or inclined portion 19*a* to facilitate the ability of the robot vacuum cleaner to climb over objects, obstructions, and uneven surfaces as will be understood.

The robot vacuum cleaner and the motive means or wheel assembly are joined together, in one embodiment, in the following manner. The wheel support 16 is prepared for mounting in the housing 10 by inserting the dowel 25 within spring 26, and placing both into the recess in the vertical part 20. The dowel 25 is then depressed and turned so that the hook 31 of the tongue 30 engages the stop means 32 such that the dowel is locked and the spring 26 is in a compressed state. Before, or at the same time, the drive wheel 12 is fixed on the shaft 13. The entire wheel assembly is then mounted on the lower wall 24 of the housing 10 by means of the lower end of slide rail 22, after which the upper wall of the housing, with seat 29, is placed on the dowel 25 at the same time as the upper end of slide rail 22 is inserted in a corresponding recess in the upper wall 23. Then the upper wall 23 is connected to the lower wall 24 after which the hook 31 is released from the stop means 32 by turning the dowel 25. This turning motion is achieved by means of an extending lug, not shown, in the seat 29 cooperating with the upper part of the dowel 25 and which, after being turned, prevents the dowel from being unintentionally turned, thereby preventing the dowel from getting stuck in a locked position. Upon being assembled in this fashion, the weight of the vacuum cleaner, when it is placed on a surface, will rest on the springs of the two wheel assemblies and cause the springs to compress.

When the robot vacuum cleaner is placed on the floor surface, its weight causes the driving wheel supports 16, and hence the driving wheels, to move from a resilient, extended position to a partially retracted position. This is because the weight of the vacuum cleaner overcomes some portion of the force that the springs 26 create on the driving wheel supports 16 and causes the springs to compress. The vertical downward movement of the driving wheel assembly, however, is limited by the engagement of the support means 14, 15, with the floor surface. When the drive wheel assemblies are retracted upwardly, under the influence of the weight of the vacuum cleaner, the outer ends of the arms 34 are disengaged from the microswitches 35, signaling the electric circuit of the robot vacuum cleaner and notifying the microprocessor so as to activate the vacuum cleaner which, then, begins to move over the floor surface.

When the robot vacuum cleaner is thus activated, it will move forward on the floor surface (i.e. to the right in FIG. 2) and continue according to a movement path defined by a microprocessor. At the same time, the floor surface is brushed by the brush roll S and dust laden air and/or dirt are sucked in through the nozzle M by means of the fan unit V. The dust laden air and/or dirt flow into the filter container F where particles, dirt, and other solids are separated from the air while the air continues to flow through the fan to several outlet openings in the housing, whereby the air exits the robot vacuum cleaner.

If, during the movement of the robot vacuum cleaner, the slanted or inclined portion 19*a* at the front part of the bottom of the housing 10 engages a raised obstacle or object on the floor surface (for instance a threshold or the end of a rug), the part of the robot vacuum cleaner which engages the obstacle or object will rise, tilting or pivoting the vacuum cleaner about the rear support means 14. As a result, the driving wheel assemblies, including the driving wheel supports, with drive wheels 12, will be forced downwards by the compression spring so that the drive wheels are kept in contact with the floor surface and continue to move the vacuum cleaner over the obstacle. As will be understood, tilting of the robot vacuum cleaner in one direction or another and the degree of tilting will occur under a variety of circumstances under the influence of the torque of the drive wheels and the location of the center of gravity with respect to the drive wheels and the various support means. The present invention causes the driving wheels to remain in contact with the floor surface so that the robot vacuum cleaner will continue to be propelled forward except in those instances where the degree of tilting is so great that the driving wheels are extended out of contact with the floor surface causing a microswitch to turn off the electric power to the vacuum cleaner. The foregoing attributes of the present invention facilitate the movement of the vacuum cleaner on soft rugs where the wheels have a tendency to sink down heavily into the rug.

When the vacuum cleaner moves on a hard floor and the support means 14, 15 is in contact with the floor surface, the nozzle M will be located slightly above the floor surface, whereby dust laden air and dirt flows into the gap between the floor surface and the nozzle. When the vacuum cleaner moves on a soft floor, for example a rug, the support means and driving wheels will sink down somewhat into the rug whereby the nozzle opening touches, or very nearly touches, the rug surface.

The invention claimed is:

1. An assembly by means of which a carrier may move over a surface irrespective of obstructions or obstacles on the surface, the assembly comprising a motive means for engaging and moving over the surface so as to transport the carrier when the motive means is in an operative mode with the carrier, the motive means being adapted for displacement in both upward and downward directions and actuating means associated with the motive means for actuating a control mechanism when the motive means is in the operative mode and the motive means is in a predetermined position along its path of upward and downward movement.

2. The assembly of claim 1, wherein the motive means includes a support means and a force-creating means for providing support along a vertical path supported by the support means for urging the motive means in a direction downward from the carrier when the assembly is in the operative mode.

3. The assembly of claim 2 wherein the motive means includes a guide means slidably connected to the support means and adapted to be fixed to the carrier so as to cause the motive means to traverse a vertical path in its upward and downward displacement.

4. The assembly of claim 3 wherein the motive means includes a power source mounted on the support means for providing power to the motive means.

5. The assembly of claim 4 wherein the motive means includes a wheel fixed to a shaft rotatably mounted on the support means and driven by the power source.

6. The assembly of claim 5 wherein the motive means includes a transmission means mounted on the support means and interposed between the power source and wheel for operatively connecting the power source and the shaft.

7. The assembly of claim 6 wherein the force-creating means is a compression spring.

8. A motive means for engaging and moving over a surface so as to transport a carrier when the motive means is in an operative mode with the carrier, the motive means being adapted for displacement in both upward and downward directions, the motive means including:

a support means for providing support along a vertical path, force-creating means supported by the support means for urging the motive means in a direction downward from the carrier when the motive means is in the operative mode and a guide means slidably connected to the support means and adapted to be fixed to the carrier so as to cause the motive means to traverse a vertical path in its upward and downward displacement, the motive means further including a power source mounted on the support means for providing power to the motive means.

9. The motive means of claim 8 including a wheel fixed to a shaft rotatably mounted on the support means and driven by the power source.

10. The motive means of claim 9 including a transmission means mounted on the support means and interposed between the power source and wheel for operatively connecting the power source and the shaft.

11. The motive means of claim 10 wherein the force-creating means is a compression spring.

12. An autonomous surface-conditioning apparatus having a housing containing surface-conditioning elements and including a control mechanism for controlling the operation of the surface-conditioning apparatus, and a motive means attached to the housing by means of which the apparatus may move over a surface being conditioned irrespective of obstructions or obstacles on the surface, the motive means being adapted for displacement in both upward and downward directions and including actuating means for actuating the control mechanism when the motive means is in a predetermined position along its path of upward and downward displacement.

13. The autonomous surface-conditioning apparatus of claim 12 wherein the motive means for providing support along a vertical path includes a support means and a force-creating means supported by the support means for urging the motive means in a direction downward from the apparatus.

14. The autonomous surface-conditioning apparatus of claim 13 wherein the motive means includes a guide means slidably connected to the support means and fixed to the apparatus so as to cause the motive means to traverse a vertical path in its upward and downward displacement.

15. The autonomous surface-conditioning apparatus of claim 14 wherein the motive means includes a power source mounted on the support means for providing power to the motive means.

16. The autonomous surface-conditioning apparatus of claim 15 wherein the motive means includes a wheel fixed to a shaft rotatably mounted on the support means and driven by the power source.

17. The autonomous surface-conditioning apparatus of claim 16 wherein the motive means includes a transmission means mounted on the support means and interposed between the power source and wheel for operatively connecting the power source and the shaft.

18. The autonomous surface-conditioning apparatus of claim 17 wherein the force-creating means is a compression spring.

19. The autonomous surface-conditioning apparatus of claim 12 wherein the surface-conditioning elements comprise elements for vacuum cleaning a surface.

20. The autonomous surface-conditioning apparatus of claim 19 including front and rear rotatable support means rotatably fixed to the bottom of the apparatus and acting to both establish a gap between the bottom of the apparatus and the surface being conditioned and a site about which the apparatus may tilt.

21. The autonomous surface-conditioning apparatus of claim 20 including a further rotatable support means rotatably fixed to the bottom of the apparatus forwardly and upwardly of the front rotatable support means.

22. The autonomous surface-conditioning apparatus of claim 21 wherein the front portion of the bottom of the apparatus is slanted upwardly in an outward direction.

23. An autonomous surface-conditioning apparatus having a housing containing surface-conditioning elements and including an assembly attached to the housing by means of which the apparatus may move over a surface being conditioned irrespective of obstructions or obstacles on the surface, the assembly comprising a motive means for engaging and moving over the surface so as to transport the apparatus, the motive means being adapted for displacement in both upward and downward directions, the motive means including a support means for providing support along a vertical path, a force-creating means supported by the support means for urging the motive means in a direction downward from the apparatus, and a guide means fixed to the apparatus and slidably connected to the support means so as to cause the motive means to traverse a vertical path in its upward and downward displacement.

24. The autonomous surface-conditioning apparatus of claim 23 wherein the motive means includes a power source mounted on the support means for providing power to the motive means.

25. The autonomous surface-conditioning apparatus of claim 24 wherein the motive means includes a wheel fixed to a shaft rotatably mounted on the support means and driven by the power source.

26. The autonomous surface-conditioning apparatus of claim 25 wherein the motive means includes a transmission means mounted on the support means and interposed between the power source and wheel for operatively connecting the power source and the shaft.

27. The autonomous surface-conditioning apparatus of claim 26 wherein the force-creating means is a compression spring.

28. The autonomous surface-conditioning apparatus of claim 23 wherein the surface-conditioning elements comprise elements for vacuum cleaning a surface.

29. The autonomous surface-conditioning apparatus of claim 28 including front and rear rotatable support means rotatably fixed to the base of the apparatus and acting to both establish a gap between the bottom of the apparatus and the surface being conditioned and a site about which the apparatus may tilt.

30. The autonomous surface-conditioning apparatus of claim 29 including a further rotatable support means rotatably fixed to the bottom of the apparatus forwardly and upwardly of the front rotatable support means.

31. The autonomous surface-conditioning apparatus of claim 30 wherein the front portion of the bottom of the apparatus is slanted upwardly in an outward direction.

32. An autonomous surface-conditioning apparatus having a housing containing surface-conditioning elements and including an assembly attached to the housing by means of which the apparatus may move over a surface being conditioned irrespective of obstructions or obstacles on the surface, the assembly comprising a motive means for engaging and moving over the surface so as to transport the apparatus, the motive means being adapted for displacement in both upward and downward directions, front and rear rotatable support means rotatably fixed to the bottom of the apparatus and acting to both establish a gap between the bottom of the apparatus and the surface being conditioned and a site about which the apparatus may tilt.

33. The autonomous surface-conditioning apparatus of claim 32 wherein the surface-conditioning elements comprise elements for vacuum cleaning a surface.

34. The autonomous surface-conditioning apparatus of claim 32 including a further rotatable support means rotatably fixed to the bottom of the apparatus forwardly and upwardly of the front rotatable support means.

35. The autonomous surface-conditioning apparatus of claim 33 wherein the front portion of the bottom of the apparatus is slanted upwardly in an outward direction.

* * * * *